United States Patent [19]

Milocco et al.

[11] Patent Number: 4,972,861

[45] Date of Patent: Nov. 27, 1990

[54] WASHING MACHINE INCLUDING IMPROVED APPARATUS FOR CLEANING A RECIRCULATING FILTER THEREOF

[75] Inventors: Claudio Milocco; Gianni Santarossa; Alessandro Cantu'; Ugo Favret, all of Pordenone, Italy

[73] Assignee: Industrie Zanussi S.p.A., Pordenone, Italy

[21] Appl. No.: 440,371

[22] Filed: Nov. 22, 1989

[30] Foreign Application Priority Data

Nov. 23, 1988 [IT] Italy ..... 34059/88[U]

[51] Int. Cl.[5] ..... B08B 3/02

[52] U.S. Cl. ..... 134/104.1; 134/111; 134/200; 210/411

[58] Field of Search ..... 134/101, 104.1, 109, 134/110, 176, 200; 210/407, 411

[56] References Cited

U.S. PATENT DOCUMENTS

| | | | |
|---|---|---|---|
| 3,457,929 | 7/1969 | Madden | 134/111 X |
| 3,810,480 | 5/1974 | Smith et al. | 134/104.1 |
| 3,989,054 | 11/1976 | Mercer | 134/104.1 |
| 4,168,715 | 9/1979 | Spiegel et al. | 134/111 X |

FOREIGN PATENT DOCUMENTS

| | | |
|---|---|---|
| 0268835 | 6/1988 | European Pat. Off. . |
| .952947 | 8/1973 | Italy . |
| 2204482 | 11/1988 | United Kingdom . |

*Primary Examiner*—Frankie L. Stinson

*Attorney, Agent, or Firm*—Wenderoth, lind & Ponack

[57] ABSTRACT

A dishwashing machine includes a recirculating pump having a casing, an inlet communicating with a sump of a washing tub, an outlet communicating with a spray arm located above the sump, and an impeller rotatable within the casing in a recirculating direction during a washing phase of operation of the machine and rotatable in a direction opposite to the recirculating direction during a drain phase of operation of the machine. A recirculating filter is positioned between the spray arm and the sump. To ensure that all water collected in the sump adjacent the inlet of the recirculating pump is discharged during the drain phase of operation of the machine, a conduit has a first end connected to the interior of the casing of the recirculating pump and a second end positioned adjacent the recirculating filter. A passage through the conduit has a cross section that is calibrated to achieve, upon the impeller of the recirculating pump rotating in the opposite direction thereof, discharge of water collected in the sump adjacent the inlet of the recirculating pump as a water jet from the second end of the passage. Such water jet passes through and cleans the recirculating filter and is directed toward the intake of a drain pump of the machine.

19 Claims, 3 Drawing Sheets

WASHING MACHINE INCLUDING IMPROVED APPARATUS FOR CLEANING A RECIRCULATING FILTER THEREOF

BACKGROUND OF THE INVENTION

The present invention relates to a washing machine including an improved apparatus for cleaning a recirculating filter of the machine, and to such apparatus for use in a washing machine.

More particularly, the present invention relates to such an improved washing machine and apparatus wherein a recirculating filter, for filtering impurities from water recirculated during a recirculating or washing phase of operation of the machine, is automatically cleaned at the end of each operating cycle of the machine.

British Pat. No. 2,204,482 discloses a dishwashing machine including a washing tub having at the bottom thereof a water collecting sump, a rotary spray arm mounted within the tub above the sump, a recirculating pump recirculating water from the sump through the rotary spray arm, and a fine-mesh recirculating filter disposed in the tub in the path of water between the rotary spray arm and the recirculating pump. The recirculating filter includes a substantially or relatively flat portion positioned between the rotary spray arm and the sump and having an opening directly connecting the interior of the tub to the intake of a drain pump that is operated during a drain phase of operation of the washing machine to drain water from the tub. The recirculating filter also includes a substantially cylindrical or frustoconical portion surrounding the opening in the substantially flat portion and extending downwardly therefrom. The two portions of the filter are substantially concentric with respect to the axis of rotation of the rotary spray arm, and the rotary spray arm is capable of directing toward the filter at least one jet of water substantially tangentially to the surface of the filter that lies upstream with respect to the path of water flow. This arrangement, that preferably includes one water jet tangential to the flat portion of the filter and another water jet tangential to the cylindrical portion of the filter, is advantageous in that it enables particles of dirt or impurities which are retained by the entire surface of the recirculating filter to be passed automatically toward the drain during operation of the recirculating pump. However, the intake of the drain pump is substantially separate from the inlet of the recirculating pump. As a result, during the drain phase of operation of the machine, any water collected at the bottom of the sump cannot be entirely withdrawn or evacuated from the sump. This particularly is true with regard to any such water at the bottom of the sump adjacent the inlet of the recirculating pump. This water becomes progressively dirtier, and it is desirable that such water be evacuated from the sump during the drain phase of operation of the machine.

A system for evacuating such residual soiled water collected at the bottom of the sump and adjacent the hydraulic recirculation circuit is disclosed in Italian No. 1,187,294 wherein there is shown a dishwashing machine in which the intakes or inlets of the recirculating and drain pumps are connected to one another by a conduit having a first portion extending from the intake of the drain pump upwardly and a second portion extending downwardly to a level which is adjacent to but higher than the bottom of the water collecting sump.

The hydrostatic and hydrodynamic characteristics of the hydraulic circuit are such that an effective connection between the two intakes or inlets of the pumps occurs only when the drain pump is in operation. Accordingly, it is the drain pump which is operated to discharge residual soiled water collected at the bottom of the sump, i.e. at the bottom of the recirculation circuit. However, to ensure that this system operates it is necessary that the hydrostatic and hydrodynamic characteristics of the hydraulic circuit be controlled very accurately. This however is not possible to achieve at all times, and as a result this system is unsatisfactory. Furthermore, upon the occurrence of an accidental malfunction of the hydraulic circuit, there will be provided a direct connection established, for the duration of the remaining part of the operating or washing cycle of the machine, between the water discharge portion of the machine and the washing or recirculating section thereof. Upon such an occurrence, the washing or recirculating operation will be carried out by soiled or dirtied water, and this results in the entire washing machine not functioning properly.

Italian Pat. No. 952,947 discloses a dishwashing machine provided with a single pump capable of feeding water drawn in from the collecting sump alternately to the rotary spray arm and to an ejector associated with a drain hose of the machine. The ejector is provided with a branch pipe terminating in a nozzle extending toward a conical portion of the recirculating filter, so that during the drain phases of operation of the machine the pump discharges water and the conical portion of the recirculating filter is partially cleaned by a water jet discharged from the nozzle. In practice however, this system is unsatisfactory. For example, the delivery of the pump is connected with the water recirculation and the water discharge or drain circuits through respective solenoid valves that have to be selectively and alternately opened and closed to perform the various phases of circulation and discharge of water. Due to the necessity of provision of these solenoid valves, that are notoriously unreliable, and the respective control devices therefor, the washing machine as a result becomes undesirably complicated. Furthermore, the entire drain system is scarcely effective in operation, particularly with regard to the final phases of drainage of residual water from the wash tub, since the water flows provided both by the ejector and by the nozzle are variable, that is such flows decrease with a decreasing level of residual water.

SUMMARY OF THE INVENTION

With the above discussion in mind, it is an object of the present invention to provide an improved dishwashing machine and apparatus whereby it is possible to overcome the above and other prior art disadvantages.

It is another object of the present invention to provide such a dishwashing machine and apparatus of simple and reliable construction and whereby it is possible both to effectively clean the recirculating filter and to ensure that the water collecting sump can be substantially entirely emptied during the water discharge or drain phases of operation of the washing machine without effecting the washing performance of the machine.

These objects of the present invention are achieved by the provision of a passage, for example defined within a conduit, having a first end connected to the interior of the casing of the recirculating pump and a second end positioned adjacent the recirculating filter. The passage has a cross section calibrated to achieve, upon the impeller of the recirculating pump being rotated in a direction reverse to the normal recirculating direction of rotation thereof, discharging water collected in the sump adjacent the inlet of the recirculating pump as a water jet from the second end of the passage. As a result, the water jet passes through the recirculating filter, in a direction counter to the direction of flow of water therethrough during the washing phase of operation of the washing machine, and thereby cleans the recirculating filter. This water jet is formed of residual water collected in the bottom of the sump adjacent the inlet of the recirculating pump, i.e. of water that normally would not be discharged by operation of the drain pump alone. This water jet is directed through the recirculating filter and toward the intake of the drain pump.

As a result, in accordance with the present invention it is possible to achieve both automatic cleaning of the recirculating filter and also discharge of substantially all water remaining at the bottom of the sump of the washing machine and that would not normally be discharged by the drain pump during the drain phase of operation of the washing machine.

BRIEF DESCRIPTION OF TH DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 1:
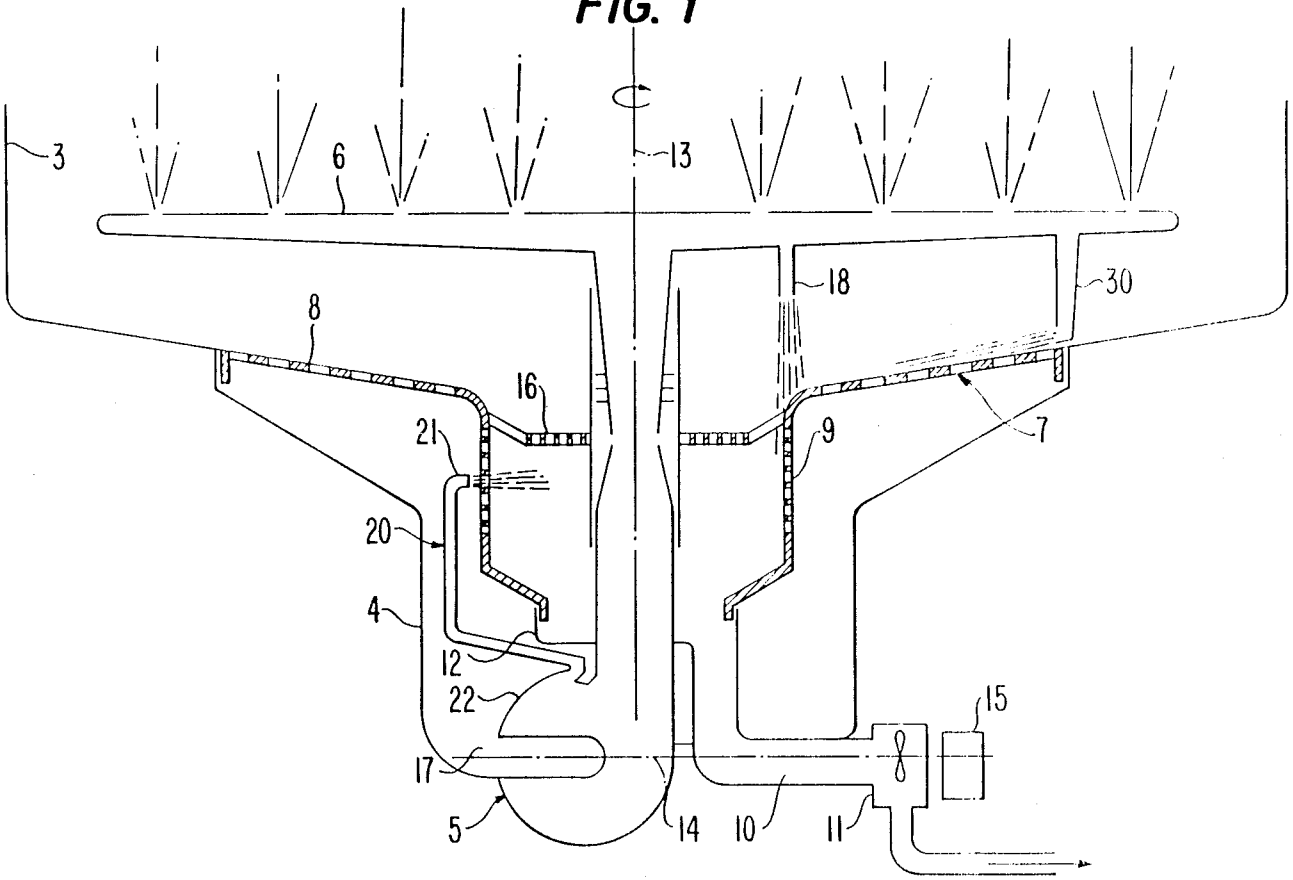
FIG. 1 is a schematic sectional view of a dishwashing machine according to one embodiment of the present invention.

In FIG. 1 there is schematically shown portions of a dishwashing machine including a washing tub 3 (partially shown) having at the bottom thereof a water collecting sump 4 for collecting washing and rinsing water during a washing or recirculating phase of operation of the washing machine. At least one rotary spray arm 6 is mounted within tub 3 above sump 4 and is adapted to rotate about an axis of rotation 13 while spraying dishes or crockery located within washing tub 3 with water. A recirculating pump 5 includes a casing 22, an inlet 17 in communication with sump 4, an outlet communicating with spray arm 6, and an impeller 24 (FIG. 2) rotatable within casing 22 in a recirculating direction during a washing phase of operation of the washing machine to pass water from sump 4 to spray arm 6, thereby causing rotation of spray arm 6 about axis 13, and also causing such water to be sprayed by spray arm 6 against dishes or crockery located within tub 3. Such water then falls downwardly and eventually is collected in sump 4. This operation continues such that the water is recirculated in such manner during the washing phase of operation of the pump.

A drain pump 11 has an inlet or intake 10 communicating with the interior of the tub 3 such that upon rotation of an impeller (shown schematically in FIG. 1) in pump 11 water within the tub is pumped to a discharge or drain, thereby emptying the water from the washing machine.

A fine-mesh recirculating filter 7 is disposed within tub 3 in the path of flow of water that, after spraying the dishes or crockery within tub 3, collects in sump 4 and then again is recirculated by pump 5. Filter 7 includes a relatively or substantially flat portion 8 (preferably of slightly frustoconical configuration) having therein a central opening directly connecting the interior of tub 3 to the intake 10 of drain pump 11. Filter 7 also has a substantially cylindrical or frustoconical portion 9 surrounding such opening and extending downwardly from flat portion 8 to a wall 12 connected to intake 10 of drain pump 11. Both portions 8 and 9 of filter 7 are substantially concentric with respect to the axis of rotation 13 of spray arm 6. Removably housed within portion 9 of filter 7 is a coarse-mesh filter 16 for the purpose of protecting drain pump 11 and which may be constructed and arranged in a known manner, for example as disclosed in British No. 2,204,482.

The impellers of both pumps 5, 11 are connected, for example keyed, to a common drive shaft 14 of a reversible electric motor 15 and are arranged to alternately pump from their respective delivery sides or outlets water that is drawn in through respective inlets or intakes 17, 10. More specifically, shaft 14 is rotated in a first direction during a recirculating or washing phase of operation of the machine. As a result, the impeller 24 of pump 5 is rotated in a recirculating direction (opposite to the direction of arrow 28 in FIG. 2) to pump water from sump 4 to spray arm 6. At the same time, the impeller of drain pump 11 is rotated in a direction opposite to a discharge direction of rotation thereof. On the other hand, during a discharge or drain phase of operation of the washing machine, drive shaft 14 is rotated in a second direction, thereby rotating the impeller of drain pump 11 in the discharge direction to discharge water from tub 3 to the outlet of pump 11. At the same time, shaft 14 rotates impeller 24 of pump 5 in direction 28 that is opposite to the normal recirculating direction of rotation of impeller 24. Pumps 5, 11 may be arranged in the manner described in European No. 0,268,835. Accordingly, recirculating pump 5 may be of the centrifugal type and be provided with an impeller 24 of the so-called "action" type, i.e. including blades oriented forwardly with respect to the direction of rotation of the impeller when pump 5 is rotated in the recirculating direction of rotation thereof (i.e. opposite to arrow 28 in FIG. 2).

In any case, the intakes or inlets 17, 10 of pumps 5, 11, respectively, are substantially separated from one another. More particularly, they are connected only through filter 7. Furthermore, inlet 10 of pump 11 will remove water only down to a level above the inlet 17 of pump 5, as will be apparent from a consideration of FIG. 1. Therefore, during the discharge or drain phase of operation of the washing machine, pump 11 cannot withdraw or discharge all of the water in the bottom of sump 4. Thus, some water will remain in the bottom of sump 4 and become continually soiled, particularly in the area of the inlet 17 of pump 5.

However, in accordance with the present invention, it is possible to ensure, during the drain phase of operation of the machine, that substantially all of the water from sump 4 that becomes collected therein, particularly adjacent the inlet 17 of pump 5, will be withdrawn and passed to a position whereat pump 11 can discharge such residual water. More particularly, a hydraulic passage, for example defined within a conduit 20, has a first end connected to the interior of casing 22 of pump 5 and a second end 21 positioned adjacent filter 7. Thus, conduit 20 extends generally upwardly and terminates in end 21 that is directed toward filter 7, preferably circumferential portion 9 thereof. The passage within conduit 20 has a cross section that is calibrated or dimensioned to achieve, upon drive shaft 14 rotating in the second direction and thereby rotating impeller 24 in the opposite direction thereof, discharging of water collected in sump 4 adjacent inlet 17 as a water jet (shown in FIG. 1) from end 21. Such water jet passes through recirculating filter 7 in a direction counter to the direction of flow of water therethrough during the washing phase of operation of the machine. This achieves cleaning of the filter, at least of portion 9 thereof. This water jet is formed by residual water collected at the bottom of sump 4 and such water is passed through filter portion 9 toward intake 10 of pump 11. As a result, it is possible to ensure that such residual water is discharged, while at the same time achieving cleaning of the filter by such residual water.

During the drain phase of operation of the machine, i.e. when pump 11 is in operation and impeller 24 of pump 5 is being driven in its reverse direction of rotation, the pressure head of pump 5 is less than that during rotation of impeller 24 in the normal recirculating direction of rotation. This reduced pressure head will be insufficient to feed water to rotary spray arm 6, but will be sufficient to produce the water jet discharged through end 21. This can be controlled by suitable calibration of the cross section of the passage through conduit 20. It will be understood that it is desirable that the water jet be discharged from conduit 20 only during the drain phase of operation of the machine. It would be undesirable to provide discharge of the water jet through conduit 20 during the recirculating phase of operation, since this would interfere with the circulating operation by reducing the flow of water from circulating pump 5 to spray arm 6.

Figure 2:
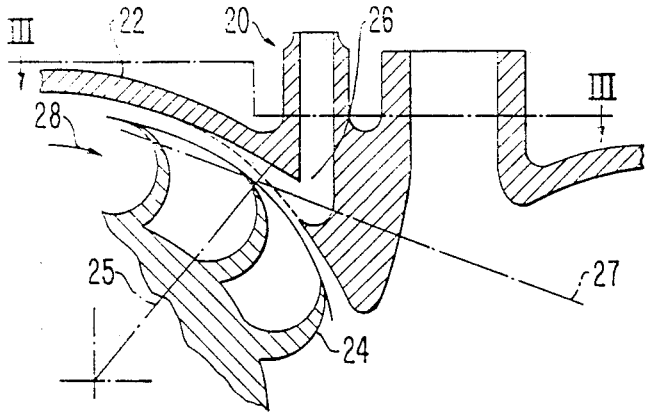
FIG. 2 is an enlarged partial sectional view of a portion of the machine of FIG. 1.

Therefore, in accordance with a further feature of the present invention it is possible to prevent water flow through conduit 21 during the recirculating phase of operation by taking advantage of the intrinsic characteristics of a centrifugal pump 5 of the "action" type. More particularly, in such a pump the casing 22 is a spiral casing, i.e. of volute shape. By branching conduit 20 from the region of volute casing 22 having the smallest radius, it is possible to avoid water flow through conduit 20 during rotation of impeller 24 in the normal direction of rotation. Thus, it is known that at such region of a volute-shaped casing of an action centrifugal pump, the hydraulic pressure is reduced, regardless of the direction of rotation of the impeller. Furthermore, in accordance with the present invention it is possible to provide that the rate of flow of water through conduit 20 will be substantially negligible during rotation of impeller 24 in the normal direction of rotation, while being suitably high during opposite rotation, i.e. during a drain phase of operation of the machine, by providing that conduit 20 is joined to volute-shaped casing 22 with a countersunk connection or mouthpiece 26 of a particular shape. Thus, the inlet to mouthpiece 26 is directed, as shown in FIG. 2, in a manner such that a central axis 27 thereof is inclined, with respect to the radius 25 of impeller 24, in the direction of reverse or opposite rotation of impeller 24 (as indicated by arrow 28). It will be apparent that rotation of impeller 24 in direction 28 will result in pressurized flow through mouthpiece 26 and the conduit, whereas rotation of the impeller in the opposite, normal direction will not result in pressurized water flow through the mouthpiece and conduit.

Figure 3:
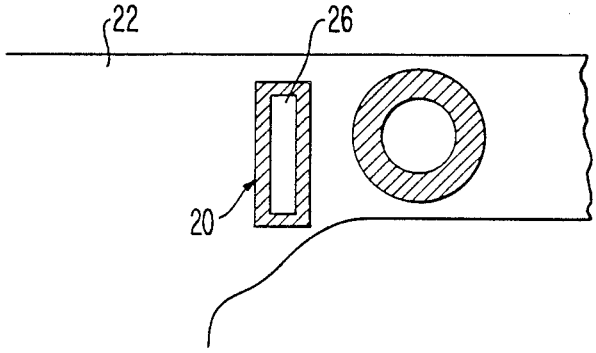
FIG. 3 is a sectional view taken line III—III of FIG. 2.

In accordance with a still further feature of the present invention, the cross section of mouthpiece 26 is preferably rectangular, as shown in FIG. 3, and includes shorter sides extending in the direction of rotation of impeller 24. By suitably sizing or dimensioning the rectangular cross section of mouthpiece 26, as well as the angle incidence of axis 27 with respect to volute casing 22, it is possible to adjust the rate of flow of water through conduit 20 and, accordingly, to obtain the desired operation described above. It is apparent that one skilled in the art, given the present disclosure, would understand how to adjust these parameters to achieve the desired result as discussed above.

Figure 4:
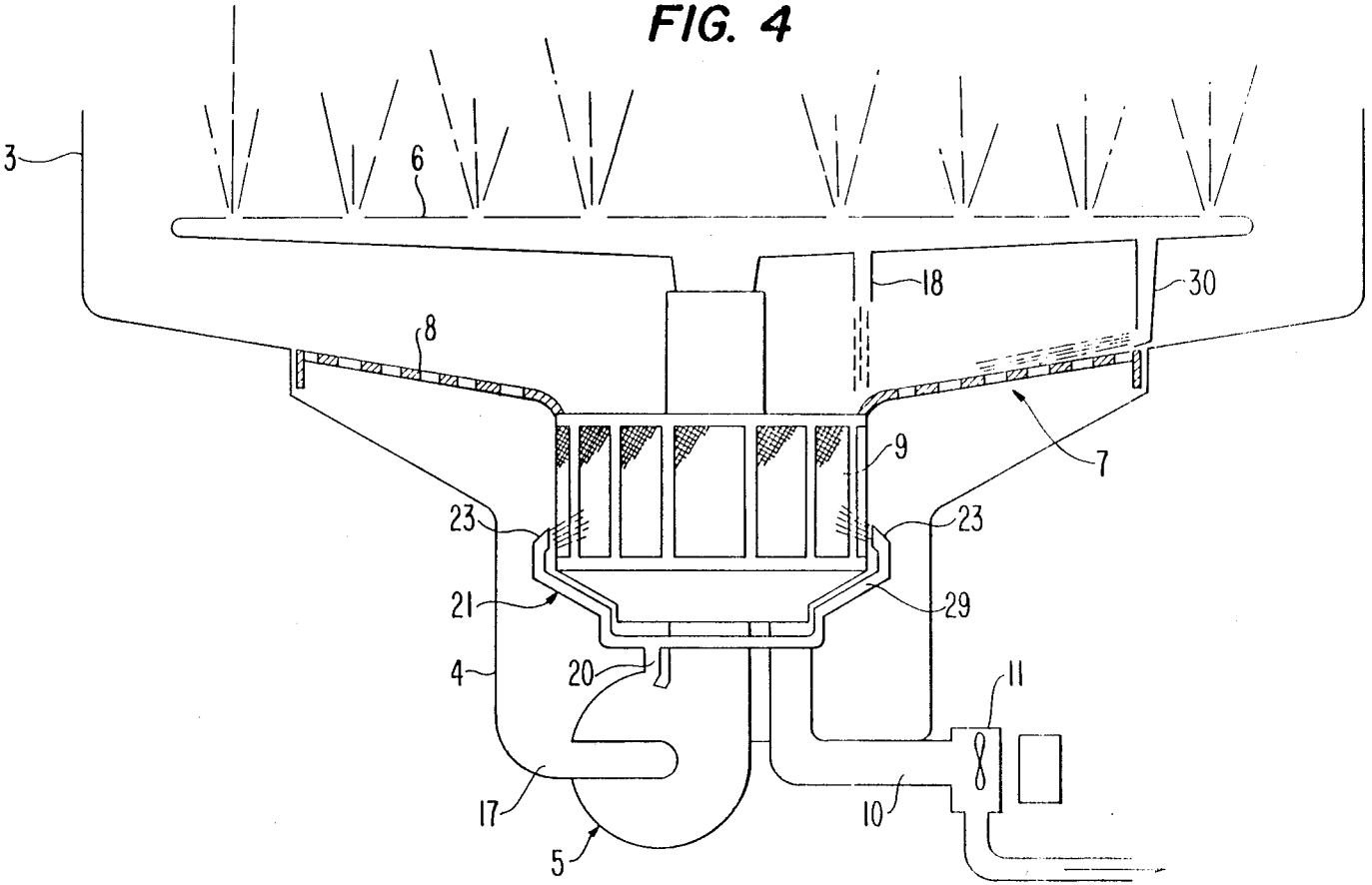
FIG. 4 is a view similar to FIG. 1 but of another embodiment of the present invention.

In accordance with a further feature of the present invention, illustrated in FIG. 4, it is possible to improve the degree of cleaning of filter 7. Thus, conduit 20 can be connected to a ring-like tubular collector or header 29 that surrounds the cylindrical portion 9 of filter 7. Tubular collector 29 has therein a plurality of nozzles 23 (for example distributed or spaced circumferentially) directed toward filter 27. This embodiment of the present invention may be modified in different manners as would be understood by one skilled in the art.

Although the present invention has been described and illustrated with respect to preferred features thereof, it is to be understood that various modifications and changes may be made to the specifically described and illustrated features without departing from the scope of the present invention.

For example, spray arm 6 may be provided on its lower side with further nozzles 18, 30 for directing respective water jets tangentially onto cylindrical portion 9 and onto flat portion 8 of the recirculating filter, for achieving automatic washing thereof. Such washing or cleaning is complete and effective, even during washing phases of operation of the machine. Such an arrangement is disclosed in British No. 2,204,482.

In accordance with the present invention, it is possible to achieve an important advantage in that all of the residual water collected at the bottom of the washing tub can be discharged without the necessity of the use of specific electro-mechanical devices and hydraulic arrangements that would even accidentally put the water recirculating circuit in direct communication with the water discharge circuit. In fact, according to the present invention, such two hydraulic circuits always are separated from one another by means of fine-mesh recirculating filter 7.

We claim:

1. In a dishwashing machine comprising a washing tub having at the bottom thereof a water collecting sump, a rotary spray arm mounted within said tub above said sump, a recirculating pump including a casing, an inlet communicating with said sump, an outlet communicating with said spray arm, and an impeller rotatable within said casing in a recirculating direction during a washing phase of operation of said machine to pass water from said sump to said spray arm, after which the water collects in said sump, and rotatable in a direction opposite to said recirculating direction during a drain phase of operation of said machine, a drain pump having an intake communicating with the interior of said tub, an outlet, and an impeller rotatable in a discharge direction during the drain phase of operation of said machine to discharge water from said tub to said outlet and rotatable in a direction opposite to said discharge direction during the recirculating phase of operation of said machine, a reversible drive shaft connected to said impellers of said recirculating and drain pumps and alternately rotatable in opposite first and second directions during said recirculating and drain phases of operation, respectively, of said machine to rotate said impeller of said recirculating pump in said recirculating direction and to rotate said impeller of said drain pump in said discharge direction, respectively, and a recirculating filter disposed in said tub to filter water drawn in by said recirculating pump, said recirculating filter including a relatively flat portion positioned between said spray arm and said sump and having an opening directly connecting said interior of said tub to said intake of said drain pump and a substantially cylindrical or frustoconical portion surrounding said opening and extending downwardly from said flat portion, the improvement comprising means for, during said drain phase of operation of said machine, ensuring the discharge from said sump of water collected therein adjacent said inlet of said recirculating pump, said means comprising:

a passage having a first end connected to the interior of said casing of said recirculating pump and a second end positioned adjacent said recirculating filter, said passage having a cross section calibrated to, upon said drive shaft rotating in said second direction and thereby rotating said impeller of said recirculating pump in said opposite direction thereof, discharge water collected in said sump adjacent said inlet of said recirculating pump as a water jet from said second end of said passage, such that said water jet passes through said recirculating filter, in a direction counter to the direction of flow of water therethrough during the washing phase of operation of said machine, and toward said intake of said drain pump.

2. The improvement claimed in claim 1, wherein said passage is formed in a conduit branching from said casing of said recirculating pump.

3. The improvement claimed in claim 2, wherein said conduit extends generally upwardly from said casing to said second end of said passage.

4. The improvement claimed in claim 1, wherein said recirculating pump is a centrifugal pump, said casing is a spiral casing, and said passage extends from said spiral casing at a region thereof having the smallest radius.

5. The improvement claimed in claim 1, wherein said recirculating pump comprises a centrifugal pump of the action type.

6. The improvement claimed in claim 1, wherein said second end of said passage directs the water jet toward said cylindrical or frustoconical portion of said recirculating filter.

7. The improvement claimed in claim 1, wherein said passage is connected to said interior of said casing of said recirculating pump via a mouthpiece having a central axis inclined, with respect to a radius of said impeller of said recirculating pump, in said opposite direction of rotation thereof.

8. The improvement claimed in claim 7, wherein said mouthpiece has a generally rectangular cross section including shorter sides extending in the direction of rotation of said impeller of said recirculating pump.

9. The improvement claimed in claim 1, further comprising a tubular collector connected to said second end of said passage, said tubular collector having a plurality of nozzles directed toward said recirculating filter.

10. The improvement claimed in claim 9, wherein said tubular collector surrounds said cylindrical or frustoconical portion of said recirculating filter, and said plurality of nozzles are distributed in the circumferential direction of said tubular collector.

11. An apparatus, for use in a dishwashing machine including a washing tub having at the bottom thereof a water collecting sump, a rotary spray arm mounted within the tub above the sump, a recirculating pump including a casing, an inlet communicating with the sump, an outlet communicating with the spray arm, and an impeller rotatable within the casing in a recirculating direction during a washing phase of operation of the machine to pass water from the sump to the spray arm, after which the water collects in the sump, and rotatable in a direction opposite to the recirculating direction during a drain phase of operation of the machine, a drain pump having an intake communicating with the interior of the tub, an outlet, and an impeller rotatable in a discharge direction during the drain phase of operation of the machine to discharge water from the tub to the outlet and rotatable in a direction opposite to the discharge direction during the recirculating phase of operation of the machine, a reversible drive shaft connected to the impellers of the recirculating and drain pumps and alternately rotatable in opposite first and second directions during the recirculating and drain phases of operation, respectively, of the machine to rotate the impeller of the recirculating pump in the recirculating direction and to rotate the impeller of the drain pump in the discharge direction, respectively, and a recirculating filter disposed in the tub to filter water drawn in by the recirculating pump, the recirculating filter including a relatively flat portion positioned between the spray arm and the sump and having an opening directly connecting the interior of the tub to the intake of the drain pump and a substantially cylindrical or frustoconical portion surrounding the opening and extending downwardly from the flat portion, for, during the drain phase of operation of the machine, ensuring the discharge from the sump of water collected therein adjacent the inlet of the recirculating pump, said apparatus comprising:

means defining a passage having a first end to be connected to the interior of the casing of the recirculating pump and a second end to be positioned adjacent the recirculating filter, said passage having a cross section calibrated to, upon the drive shaft rotating in the second direction and thereby rotating the impeller of the recirculating pump in the opposite direction thereof, discharge water collected in the sump adjacent the inlet of the recirculating pump as a water jet from said second end of said passage, such that said water jet passes through the recirculating filter, in a direction counter to the direction of flow of water therethrough during the washing phase of operation of the machine, and toward the intake of the drain pump.

12. An apparatus as claimed in claim 11, wherein said passage defining means comprises a conduit to be branched from the casing of the recirculating pump.

13. An apparatus as claimed in claim 12, wherein said conduit is oriented to extend generally upwardly from the casing to said second end of said passage.

14. An apparatus as claimed in claim 11, wherein the recirculating pump is a centrifugal pump, the casing is a spiral casing, and said passage is to extend from the spiral casing at a region thereof having the smallest radius.

15. An apparatus as claimed in claim 11, wherein said second end of said passage is aligned to direct the water jet toward the cylindrical or frustoconical portion of the recirculating filter.

16. An apparatus as claimed in claim 11, further comprising a mouthpiece to connect said passage to the interior of the casing of the recirculating pump, said mouthpiece having a central axis to be inclined, with respect to a radius of the impeller of the recirculating pump, in the opposite direction of rotation thereof.

17. An apparatus as claimed in claim 16, wherein said mouthpiece has a generally rectangular cross section including shorter sides aligned to extend in the direction of rotation of the impeller of the recirculating pump.

18. An apparatus as claimed in claim 11, further comprising a tubular collector connected to said second end of said passage, said tubular collector having a plurality of nozzles to be directed toward the recirculating filter.

19. An apparatus as claimed in claim 18, wherein said tubular collector is constructed to surround the cylindrical or frustoconical portion of the recirculating filter, and said plurality of nozzles are distributed in the circumferential direction of said tubular collector.

* * * * *